US005163351A

United States Patent [19]

Dominka

[11] Patent Number: 5,163,351

[45] Date of Patent: Nov. 17, 1992

[54] HYDRAULIC LOCK CYLINDER

[76] Inventor: John Dominka, 36425 Maas Dr., Sterling Heights, Mich. 48312

[21] Appl. No.: 738,206

[22] Filed: Jul. 30, 1991

[51] Int. Cl.[5] ..... F15B 15/26

[52] U.S. Cl. ..... 91/44; 91/45; 91/445; 91/448; 92/28; 251/31; 251/152

[58] Field of Search ..... 91/44, 45, 426, 420, 91/421, 447, 448, 445; 92/27, 28, 24; 251/31, 152; 137/326, 328

[56] References Cited

U.S. PATENT DOCUMENTS

| | | | |
|---|---|---|---|
| 1,134,608 | 4/1915 | Gottschalk . | |
| 2,130,618 | 9/1938 | Gnavi . | |
| 2,342,812 | 2/1944 | Martinson . | |
| 2,588,520 | 3/1952 | Halgren et al. | 91/420 |
| 2,773,485 | 12/1956 | Geyer . | |
| 2,886,008 | 5/1959 | Geyer et al. . | |
| 2,918,786 | 12/1959 | Geyer . | |
| 2,923,310 | 2/1960 | Eckert, Jr. | 251/326 |
| 2,970,573 | 2/1961 | Geyer . | |
| 3,074,384 | 1/1963 | Pilch | 91/420 |
| 3,236,489 | 2/1966 | Mattocks et al. . | |
| 3,451,313 | 6/1969 | Anderson | 91/45 |
| 3,576,151 | 4/1971 | Sendoykas | 92/24 |
| 3,613,503 | 10/1971 | Phillips | 91/421 |
| 3,668,977 | 6/1972 | Beidler | 92/17 |
| 3,674,041 | 7/1972 | Beals | 251/31 |
| 3,732,783 | 5/1973 | Emenaker | 91/44 |
| 3,763,747 | 10/1973 | Beichel et al. | 92/33 |
| 4,168,865 | 9/1979 | Bogenschutz | 91/44 |
| 4,196,654 | 4/1980 | Stearns | 92/33 |
| 4,343,228 | 8/1982 | Wallis | 91/447 |
| 4,392,415 | 7/1983 | Melocik | 91/461 |
| 4,461,449 | 7/1984 | Turner | 91/420 |
| 4,462,768 | 7/1984 | Westmoreland | 417/518 |
| 4,667,570 | 5/1987 | Jensen, Jr. et al. | 91/420 |
| 4,790,234 | 12/1988 | Hampejs et al. | 91/362 |
| 5,020,418 | 6/1991 | Sendoykas | 91/17 |

FOREIGN PATENT DOCUMENTS 52-24680 2/1977 Japan .

OTHER PUBLICATIONS

IBM Technical Disclosure Bulletin vol. 8, No. 1 p. 87 Jun. 1965.

*Primary Examiner*—Thomas E. Denion
*Attorney, Agent, or Firm*—Krass & Young

[57] ABSTRACT

A hydraulic lock cylinder in which a cross bore is provided in an end structure of the cylinder housing which intersects the hydraulic fluid inlet passage to the central bore of the cylinder; a control piston is reciprocally mounted in the control bore; and pressurized fluid is admitted to the opposite ends of the control bore to shuttle the control piston within the control bore between a closed position in which the inlet passage is blocked and an open position in which the passage is open. The control piston includes a flat surface and a control port opening in the flat surface and an annular fitting screws into the inlet passage housing and includes a seal on its lower end for sealing coaction with the flat surface on the control piston to seal the inlet passsage. In one embodiment the lock mechanism is provided at the end of the cylinder housing through which the piston rod extends so that the hydraulic fluid trapped between the control piston and the adjacent end of the piston is resistant to a pulling force on the piston rod, and in another embodiment the lock mechanism is provided at the end of the cylinder housing remote from the end through which the piston rod extends so that the hydraulic fluid trapped between the control piston and the adjacent end of the piston is resistant to a pushing force on the piston rod.

17 Claims, 3 Drawing Sheets

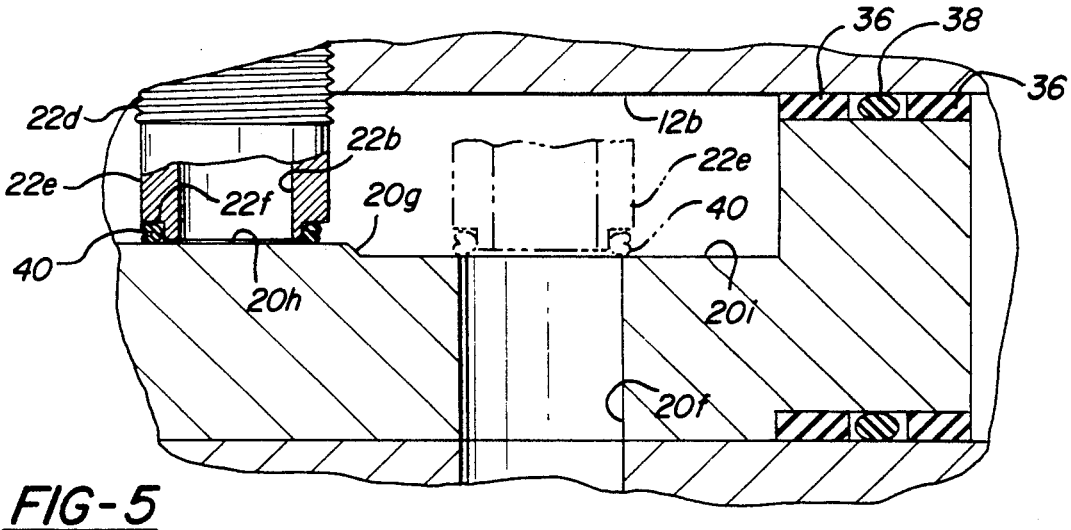
FIG-5
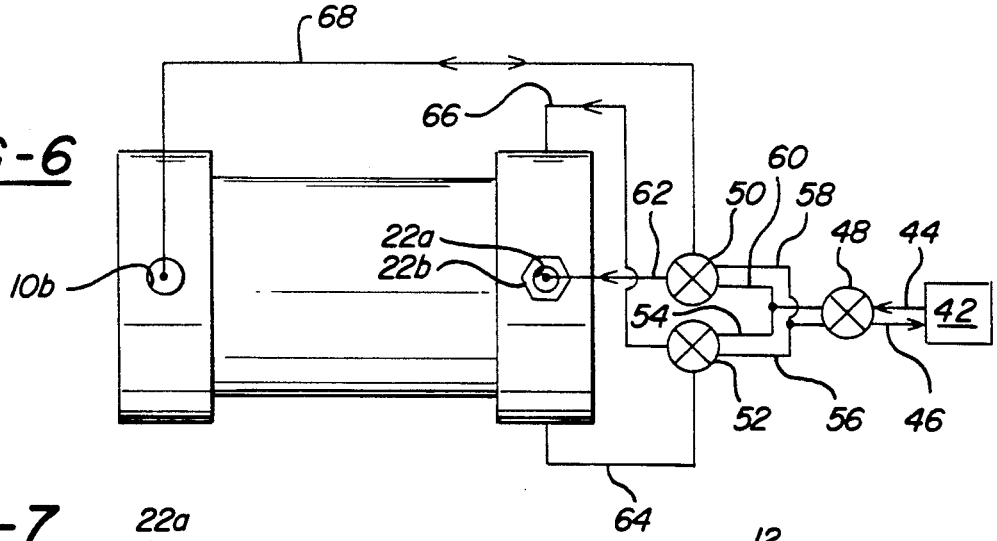
FIG-6
FIG-7
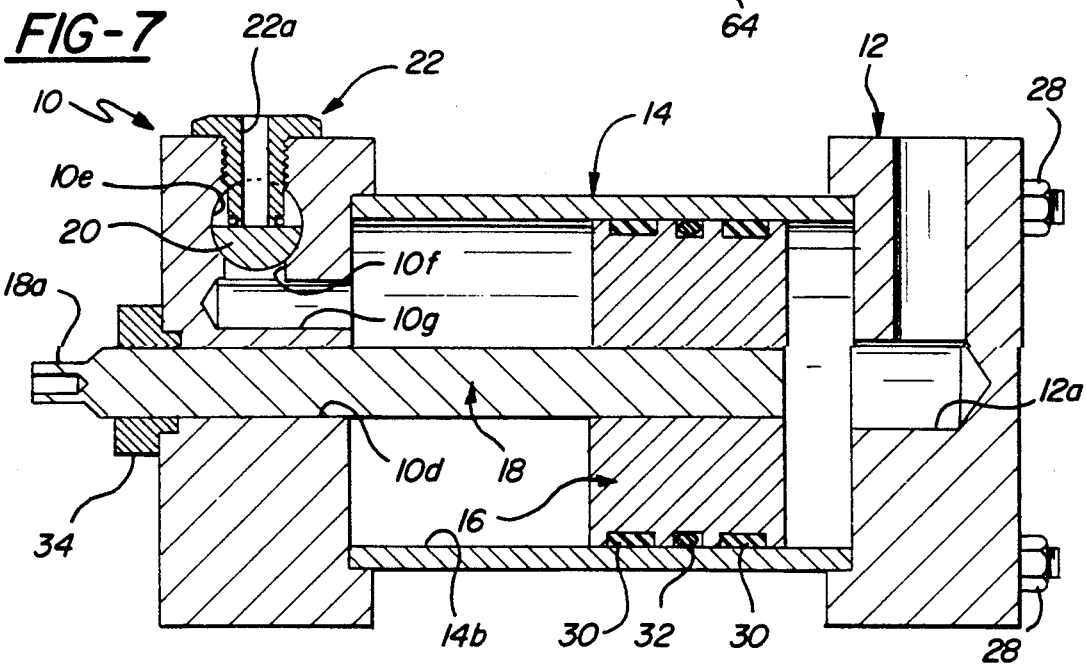

HYDRAULIC LOCK CYLINDER

BACKGROUND OF THE INVENTION

This invention relates to power cylinders operated by hydraulic pressure and more particularly to a hydraulic pressure power cylinder including means to securely lock the piston in a desired position of the piston.

Power cylinders find many applications in modern industry. For example, power cylinders are utilized to advance the slide of a tool head in a machine tool so as to bring the cutting tool to a position to operate on a workpiece. If the piston is not locked in this position of adjustment, the associated tool may bounce back and forth or chatter when it is moved against and into the work. As a further example, power cylinders are also conventionally used to operate work holding clamps. It is essential in each situation that the cylinder hold the workpiece securely and that it maintain a holding force on the work, sometimes for long periods of time and sometimes regardless of variations in the size of the work due to permissible work tolerances or other factors. It is important that the power clamps used to hold parts maintain full pressure continuously and that pressure not be relieved or even reduce appreciably at any clamp during the entire period.

It is important therefore, in these and other applications, that the power cylinder include means to ensure that the piston and thereby the associated tool or clamp maintains its position of adjustment irrespective of forces exerted against the associated tool or clamp and irrespective of pressure losses in the cylinder.

Various devices have been proposed to allow the piston to be locked in a particular position of adjustment. Whereas these prior art locking devices have been generally acceptable, they suffer from several disadvantages. Specifically, they are often able to provide locking of the piston only at particular points in the stroke of the piston and they typically have a complex structure and operation resulting in a high initial manufacturing cost and further resulting in high maintenance costs.

SUMMARY OF THE INVENTION

This invention is directed to the provision of a lock cylinder having an improved piston lock arrangement which is simple in construction and operation and which allows locking of the piston at any point in the stroke of the piston.

The invention relates to a hydraulic power cylinder of the type including a cylinder housing defining a bore, a piston mounted for reciprocal movement in the bore, a piston rod connected to the piston, and a hydraulic fluid passage in the cylinder housing communicating with one end of the bore to deliver pressurized fluid to the one bore end to act against one side of the piston and move the piston toward the other end of the bore.

According to an important feature of the invention, the cylinder includes a valve member in the fluid passage which is movable by pressurized fluid between an open position in which the passage is open and a closed position in which the passage is blocked and the hydraulic fluid between the valve and the one side of the piston is trapped to prevent return movement of the piston toward the one bore end. This arrangement allows the piston to be securely locked at any point along its stroke and accomplishes the locking with a very simple structure.

According to a further feature of the invention, the cylinder housing defines a cylinder end structure proximate the one end of the bore, the passage extends through the end structure from an entry port on the exterior of the end structure to a bore port at the one end of the bore, and the valve member is mounted for movement in a control bore that intersects the passage at a location in the end structure between the ports. This arrangement allows the valve member to be readily shuttled back and forth in the control bore between its open and closed position to quickly and effectively block the passage and thereby lock the piston in its instantaneous position within the bore of the cylinder.

According to a further feature of the invention, the valve member includes a through control port that is aligned with the passage in the open position of the valve member to allow flow of pressurized hydraulic fluid through the control port for delivery to the one bore end. This arrangement provides a simple and effective means of allowing flow of pressurized fluid to the bore in the open position of the valve member.

According to a further feature of the invention, the valve member comprises a control piston mounted for reciprocal movement in the control bore and the control bore extends through the end structure and opens in ports at opposite sides of the end structure so as to allow the delivery of pressurized fluid to opposite ends of the control bore to act on opposite ends of the control piston. This arrangement provides a simple and effective means of shuttling the control piston back and forth between its open and closed positions.

According to a further feature of the invention, the control piston defines a flat surface extending across the passage and the control port opens in the flat surface. This flat surface on the control piston facilitates sealing as between the passage and the control bore.

According to a further feature of the invention, the control piston further includes cylindrical end portions sliding in the control bore and the flat surface is defined by a cut-away central piston portion defined by a cylindrical surface sliding in the bore and by the flat surface of the control piston. This specific piston configuration provides adequate guide surface for the piston in the control bore while continuing to provide the flat surface to facilitate sealing.

According to a further feature of the invention, the cylinder further includes means defining a seal at the flat surface between the passage and the control bore so as to facilitate the sealing action between the passage and the control bore.

According to a further feature of the invention, the cylinder further includes an annular member positioned in the end structure between the central control bore and the entry port and having a central bore defining the portion of the passage between the control bore and the entry port, and the seal means includes an annular seal positioned on the inboard end of the annular member proximate the flat surface. This arrangement provides a simple and effective means of sealing the control bore from the passage.

According to a further feature of the invention, the control piston is cylindrical, the flat surface is formed on a chord of the cylindrical surface of the piston, and the annular member extends into the control bore to position the annular seal at the flat surface of the piston for sealing coaction with the flat surface.

In one embodiment of the invention, the piton rod extends out of the end of the cylinder bore remote from the end of the bore in which the hydraulic fluid is trapped by the locking mechanism so that the trapped hydraulic fluid resists a pushing force on the piston rod.

In another embodiment of the invention, the piston rod extends out of the end of the cylinder bore in which the hydraulic fluid is trapped by the locking mechanism so that the trapped hydraulic fluid resists a pulling force on the piston rod.

BRIEF DESCRIPTION OF THE DRAWINGS

FIG. 5 is a detailed view taken within the circle 5 of FIG. 2;

FIG. 6 is schematic view of a hydraulic control circuit for use with the invention lock cylinder; and FIG. 7 is a cross-sectional view of a modified form of the invention lock cylinder.

DETAILED DESCRIPTION OF THE PREFERRED EMBODIMENTS

Figure 1:
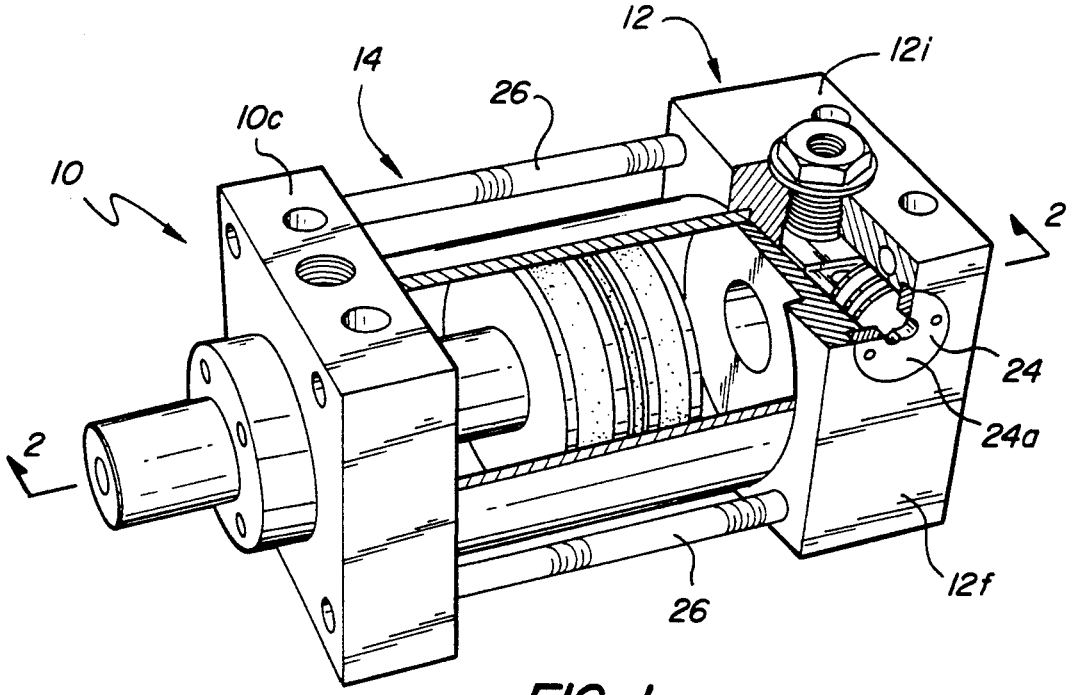
FIG. 1 is a perspective cut-away view of the invention lock cylinder.

The lock cylinder seen in FIGS. 1–6, broadly considered, includes a tailblock 10, a headblock 12, a cylinder tube 14, a piston 16, a piston rod 18, a control piston 20, and a fitting 22.

The parts of the invention lock cylinder, unless otherwise indicated, are formed of a suitable machined steel.

Tailblock 10 has a rectangular configuration and includes a passage 10*a* opening in a port 10*b* in the upper surface 10*c* of the tailblock and a central bore 10*d* extending through the tailblock.

Headblock 12 has a rectangular configuration generally corresponding to the configuration of tailblock 10 and includes a central blind bore 12*a*, a cross bore 12*b* opening at its opposite ends in threaded counter bores 12*c* and 12*d* in the opposite side faces 12*e* and 12*f* of the headblock, a passage 12*g* extending between blind bore 12*a* and cross bore 12*b*, and a threaded bore 12*h* extending between cross bore 12*b* and the upper surface 12*i* of the headblock. A pair of end caps 24 are threadably received in counter bores 12*c* and 12*d* and include central threaded apertures 24*a* for threaded receipt of suitable fittings to supply pressurized fluid to the opposite ends of cross bore 12*b*.

Cylinder tube 14 defines a central bore 14*a* and is clamped between tailblock 10 and headblock 12 in known manner by tie rods 26 received in threaded bores in the tailblock and threadably engaging nuts 28 positioned against the end surface 12*j* of the headblock.

Piston 16 is slidably received in bore 14*a* and includes a pair of nylon wear rings 30 and an annular elastomeric seal 32 received in respective annular grooves in the outer periphery of the piston for respective sliding and sealing coaction with the bore 14*a*.

Piston rod 18 is fitted in a central bore 16*a* of the piston and extends through bore 10*d* of tailblock 10 and through a bronze gland 34 positioned on the outer surface 10*e* of the tailblock to provide a working end portion 18*a* for coaction with a suitable tool, clamp or the like to perform a work operation. A tapped hold 18*b* is provided in the end portion 18*a* to facilitate attachment of the piston rod to an associated structure or device.

Control piston 20 has a generally cylindrical configuration and is sized to move slidably and reciprocally in cross bore 12*b* of headblock 12. Piston 20 includes cylindrical end portions 20*a* and 20*b* and a cut-away central portion 20*c*.

A pair of nylon rings 36 are positioned around each cylindrical end portion 20*a*, 20*b* for sliding coaction with cross bore 12*b*.

Central cut-away portion 20*c* includes a cylindrical surface 20*d* for sliding coaction with cross bore 12*b* and a flat surface 20*e* formed as a diametrical chord with respect to cylindrical surface 20*d*. A control port 20*f* extends through cut-away central portion 20*c* proximate cylindrical end portion 20*b*. Control port 20*f* opens at its upper end in flat surface 20*e* and at its lower end in cylindrical surface 20*d*. Flat surface 20*e* includes a slight shoulder 20*g* separating a relatively high portion 20*h* of the flat surface proximate end portion 20*a* and a relatively low portion 20*i* of the flat surface proximate end portion 20*b* and including control port 20*f*. Surface 20*i* may for example be 1/32 inch below surface 20*h*. When positioned slidably in bore 12*b*, an annular elastomeric seal 38 is positioned between each set of wear rings 36 to provide a seal as between the control piston and cross bore 12*b*.

Control piston 20 will be seen to have a length substantially less than the length of control bore 12*b* so that the piston may shuttle back and forth within the control bore in response to the admission of fluid pressure to the opposite ends of the control bore through the fittings attached to end caps 24. It will be seen that with the control piston in its extreme righthand solid line position as viewed in FIG. 3, in abutting engagement with the righthand end cap, the control port 20*f* is displaced with respect to headblock passage 12*g* and headblock bore 12*h* so as to preclude hydraulic fluid communication between bore 12*h* and passage 12*g* and with the control piston in its extreme lefthand dash line position as viewed in FIG. 3, in abutting engagement with the lefthand end cap, the control port 20*f* is in alignment with headblock passage 20*g* and headblock bore 12*h* so as to allow the passage of pressurized hydraulic fluid through the headblock to central bore 14*a*.

Fitting 22 is annular and defines a central through bore including an upper internally threaded portion 22*a* and a lower smooth bore portion 22*b*, a hexagonal head portion 22*c*, an externally threaded portion 22*d* immediately underlying head portion 22*c*, and a smooth shank portion 22*e* underlying externally threaded portion 22*c*. Fitting 22 is screwed into threaded bore 12*h* of the headblock so that the lower shank portion 22*e* of the fitting extends into cross bore 12*b*. The lower end of shank portion 22*e* is stepped inwardly at 22*f* to provide a seat for an annular elastomeric seal 40. Seal 40 has a relaxed U-shaped configuration in cross section. Fitting 22 is threaded downwardly relative to the headblock until the seal 40 engages the raised portion 20*h* of flat surface 20*e* and compresses slightly so as to form a positive seal as between the central bore 22*a* of the fitting and the cross bore 12*b*. The various parts are dimensioned such that as the seal 40 compresses against the raised portion 20*h* of flat surface 20*e*, the under annular surface of the head portion 22*c* of the fitting seats against the upper surface 12*i* of the headblock.

Figure 3:
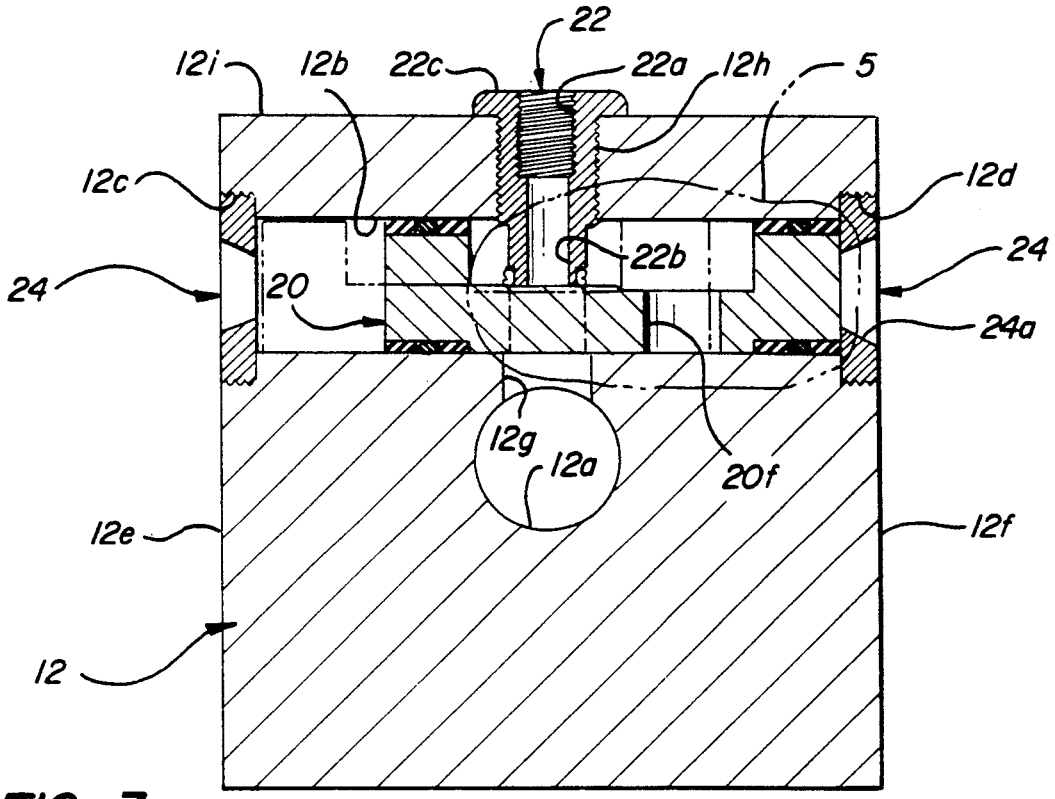
FIG. 3 is a cross-sectional view of the invention lock cylinder taken on line 3—3 of FIG. 2.
Figure 4:
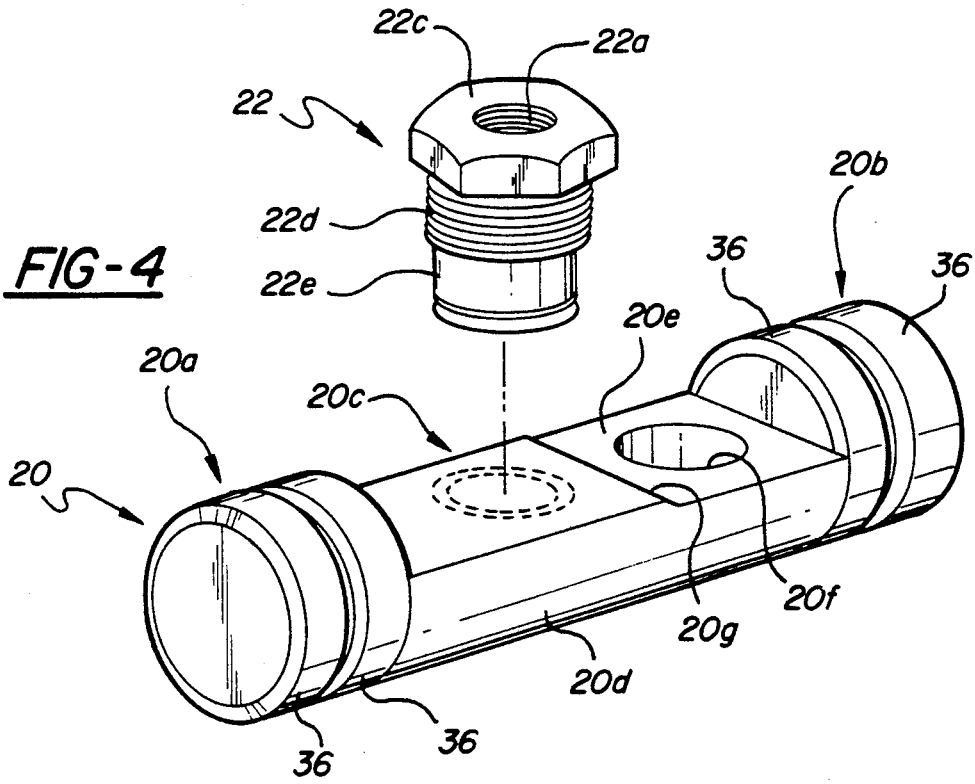
FIG. 4 is a perspective view of individual elements of the invention lock cylinder.

In operation, the control piston 20 is moved back and forth in control bore 12*b* between a closed position, seen in solid lines in FIGS. 3 and 5, wherein the seal 40 sealingly engages the raised portion 20*h* of flat surface 20*e* to positively block fluid communication between bore 22*a* and bore 12*g*, and an open position, seen in dash lines in FIGS. 3 and 5, wherein control port 20*f* is aligned with bore 22*a* and bore 12*g* so as to provide fluid communication between the exterior of the cylinder and the end surface 16*b* of piston 16 through a passage defined successively by bore 22*a*, control port 20*f*, bore 12*g*, and blind bore 12*a*. With the control piston in its open position, the seal 40 may relax slightly due to the differences in heights between the portions 20*h* and 20*i* of flat surface 20*e* so as to avoid tearing or shearing of the seal as the control piston moves back and forth within control bore 12*b*.

The hydraulic control circuit seen diagrammatically in FIG. 6 includes a source of pressurized hydraulic fluid 42, a pressure fluid outlet line 44; a pressure fluid inlet line 46; valves 48, 50 and 52; first and second lines 54 and 56 extending between valve 48 and valve 52; first and second lines 58 and 60 extending between valve 48 and valve 50; a line 62 extending between valve 50 and bore 22*a* of fitting 22; a line 64 extending between valve 52 and one end of cross bore 12*b*; a line 66 extending from valve 52 to the other end of cross bore 12*b*; and a line 68 extending from port 10*b* to valve 50.

Figure 2:
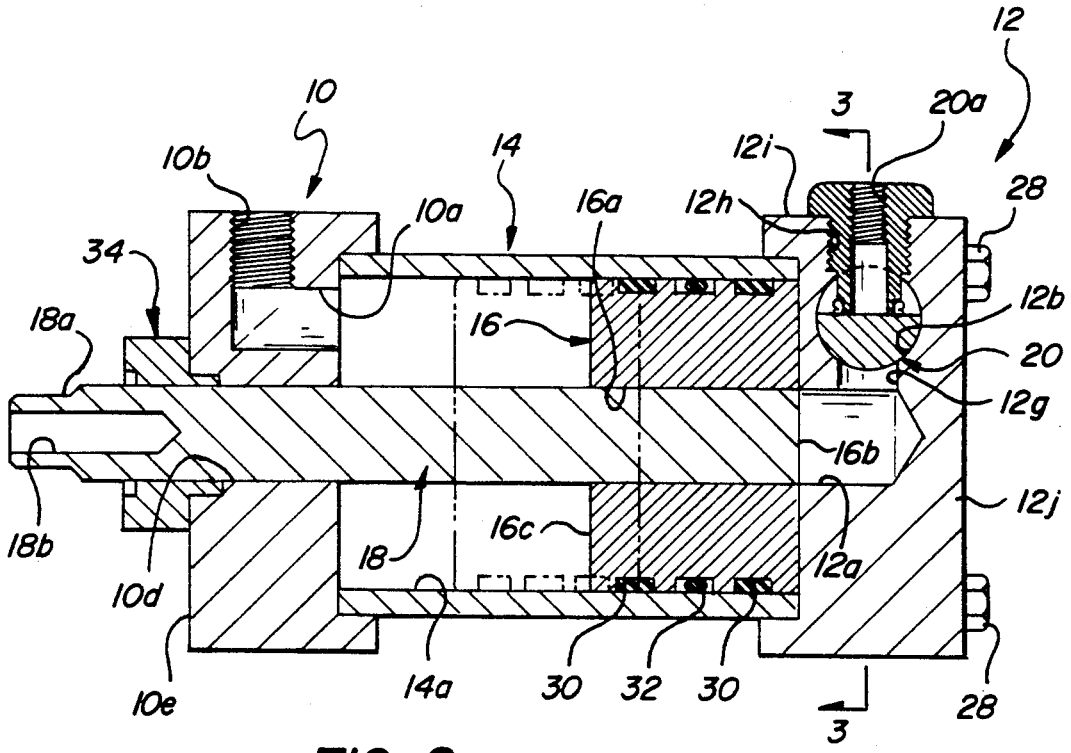
FIG. 2 is a cross sectional view of the invention lock cylinder taken on line 2—2 of FIG. 1.

In the operation of the invention cylinder, the valves are suitably positioned to allow pressurized fluid to flow from pressure source 42 to bore 12*b* in a sense to move the control piston 20 to its open position as seen in dash lines in FIG. 3; the valves are thereafter suitable positioned to allow pressurized fluid to flow to line 62 and through the passage defined by bore 22*a*, control port 20*f*, bore 12*g* and bore 12*a* to act against the side 16*a* of the piston 16 and move the piston and piston rod to the left as viewed in FIG. 2; when the piston and piston rod have reached a desired position along the stroke of the piston in bore 14*b*, the valves are suitable positioned to provide pressurized fluid to cross bore 12*b* in a sense to move the control piston from its dash line position as seen in FIG. 3 to its solid line position as seen in FIG. 3 in which annular seal 40 carried by fitting 22 coacts with raised portion 20*h* of flat surface 20*e* to block communication between bore 22*a* and the cylinder bore and to trap the hydraulic fluid between the control valve 20 and the side 16*a* of the piston so that the piston is prevented from return movement toward headblock 12 and the clamping pressure being applied by the piston against a suitable work object will be held irrespective of power failure, fitting fatigue, or line fatigue.

The lock cylinder described with reference to FIGS. 1 through 6 may be characterized as a push-to-lock cylinder in the sense that pushing action on the piston rod 18 is resisted by the bulk modulus of the hydraulic fluid trapped between piston 16 and control piston 20 so that the cylinder is locked with respect to any pushing movement.

The invention may also be supplied in a pull-to-lock version in which the piston rod is locked against pulling movement on the rod. Such a version is seen in FIG. 7 which is generally similar to the FIGS. 1–6 embodiment with the exception that the locking mechanism is provided in the tailblock rather than in the headblock so that the hydraulic fluid trapped in response to movement of the control piston to its closed position is trapped between the tailblock side 16*c* of the piston and the control piston so as to resist pulling movement on the piston rod.

Specifically, control piston 20 is mounted for reciprocal movement in a cross bore 10*e* in the tailblock and the control piston 20 in its open position allows communication between the bore 22*a* of the fitting 22, a bore 10*f* in the headblock communicating with bore 10*e*, and a further bore 10*g* in the tailblock communicating with cylinder bore 14*b*.

The invention lock cylinder, whether in the push-to-block version of FIGS. 1–6 or the pull-to-lock version of FIG. 7, provides many important advantages as compared to prior art lock cylinders. Specifically, the construction of the cylinder is extremely simple so as to minimize initial cost and so as to further minimize subsequent maintenance costs. Further, the invention lock cylinder provides positive locking of he piston in any position of the piston so that the lock cylinder need not be positioned at any predetermined critical distance from the associated clamp or other workpiece but rather may be positioned at an otherwise convenient distance from the clamp or other workpiece, moved to the particular position of piston rod extension required to provide the desired work action, and then locked in that precise position.

Whereas preferred embodiments of the invention have been illustrated and described in detail, it will be apparent that various changes may be made in the disclosed embodiments with departing from the scope or spirit of the invention.

I claim:

1. A hydraulic cylinder including a cylinder housing defining a bore, a piston mounted for reciprocal movement in the bore, a piston rod connected to the piston, and a hydraulic fluid passage in the cylinder housing communicating with one end of the bore to deliver pressurized fluid to the one bore end to act against one side of the piston and move the piston toward the other end of the bore, characterized in that a valve member is provided in the passage; the valve member is movable by pressurized fluid between an open position in which the passage is blocked and the hydraulic fluid between the valve and said one side of the piston is trapped to prevent return movement of the piston toward the one bore end; the cylinder housing defines a cylinder end structure proximate said one end of the bore; said passage extends through said end structure from an entry port on the exterior of said end structure to a bore port at said one end of said bore; said valve member is mounted for movement in a control bore that intersects the passage at a location in said end structure between said ports; said valve member comprises a control piston mounted for reciprocal movement in said control bore and includes a through control port that is aligned with said passage in the open position of said valve member to allow flow of pressurized hydraulic fluid through said control port for delivery to said one bore end; and said control bore extends through said end structure and opens in ports at opposite sides of said end structure so as to allow the delivery of pressurized fluid to opposite ends of said control bore to act on opposite ends of said control piston.

2. A cylinder according to claim 1 wherein said control piston defines a flat surface extending across said passage and said control port opens in said flat surface.

3. A cylinder according to claim 2 wherein said control piston further includes cylindrical end portions sliding in said bore and said flat surface is defined by a cut-away central portion defined by a cylindrical surface sliding in said bore and by said flat surface.

4. A cylinder according to claim 3 wherein said flat surface comprises a chord of said cylindrical surface.

5. A cylinder according to claim 4 wherein said flat surface comprises a diameter of said cylindrical surface.

6. A cylinder according to claim 2 wherein said cylinder further includes means defining a seal at said flat surface between said passage and said control bore.

7. A cylinder according to claim 6 wherein said cylinder further includes an annular member positioned in said end structure between said control bore and said entry port and having a central bore defining the portion of said passage between said control bore and said entry port.

8. A cylinder according to claim 7 wherein said seal means includes an annular seal positioned on the inboard end of said annular member proximate said flat surface for sealing coaction with said flat surface.

9. A cylinder according to claim 8 wherein said control piston is cylindrical, said flat surface is formed on a chord of the cylindrical surface of the piston, and said annular member extends into said control bore to position said annular seal at said flat surface.

10. A hydraulic power cylinder including a cylinder defining a bore, a piston mounted for reciprocal movement in the bore, a piston rod connected to the piston, and first and second passages communicating with the bore respectively proximate first and second ends of the bore to deliver and discharge pressurized hydraulic fluid to and from the bore and move the piston reciprocally in the bore, characterized in that a valve member is provided in the first passage; the valve member is movable by pressurized fluid between an open position, in which the first passage is open to allow the delivery of pressurized hydraulic fluid therethrough to said first end of the bore to apply pressure to a first side of the piston and move the piston toward said second end of said bore, and a closed position in which the first passage is blocked and the hydraulic fluid between the valve and said first side of said piston is trapped to prevent return movement of the piston toward said first end of the bore; said cylinder housing defines a cylinder end structure proximate said first end of said bore; said first passage extends through said end structure from an entry port on the exterior of said end structure to a bore port at said first end of said bore; said valve member is mounted for movement in a control bore that intersects said first passage at a location in said end structure between said ports; said valve member comprises a control piston mounted for reciprocal movement in said control bore and includes a through control port that is aligned with said first passage in the open position of said valve member to allow flow of pressurized hydraulic fluid through said control port for delivery to said first end of said bore; and said control bore extends through said end structure and opens in ports at opposite sides of said end structure so as to allow that the delivery of pressurized fluid to opposite ends of said control bore to act on opposite ends of said control piston.

11. A cylinder according to claim 10 wherein said control piston defines a flat surface extending across said first passage and said control port opens in said flat surface.

12. A cylinder according to claim 11 wherein said control piston further includes cylindrical end portions sliding in said control bore and said flat surface is defined by a cut-away central portion defined by a cylindrical surface sliding in said control bore and by said flat surface.

13. A cylinder according to claim 12 wherein said flat surface comprises a chord of said cylindrical surface.

14. A cylinder according to claim 11 wherein said cylinder further includes means defining a seal at said flat surface between said first passage and said control bore.

15. A cylinder according to claim 14 wherein said cylinder further includes an annular member positioned in said end structure between said control bore and said entry port and having a central bore defining the portion of said first passage between said control bore and said entry port.

16. A cylinder according to claim 15 wherein said seal means includes an annular seal positioned on the inboard end of said annular member proximate said flat surface for sealing coaction with said flat surface.

17. A cylinder according to claim 16 wherein said control piston is cylindrical, said flat surface is formed on a chord of the cylindrical surface of the piston, and said annular member extends into said control bore to position said annular seal at said flat surface for sealing coaction with said flat surface.

* * * * *